US006869200B1

(12) United States Patent
Graham

(10) Patent No.: US 6,869,200 B1
(45) Date of Patent: Mar. 22, 2005

(54) CANDLE HOLDER FOR JACK-O-LANTERN LID AND METHOD OF APPLYING THE SAME

(75) Inventor: James P. Graham, Norfolk, CT (US)

(73) Assignee: Northwest Enterprises LLC, Winsted, CT (US)

( * ) Notice: Subject to any disclaimer, the term of this patent is extended or adjusted under 35 U.S.C. 154(b) by 99 days.

(21) Appl. No.: 10/146,564

(22) Filed: May 14, 2002

(51) Int. Cl.[7] ..... F21V 19/00

(52) U.S. Cl. ..... 362/161; 362/181; 362/172; 362/156; 362/154; 362/122

(58) Field of Search ..... 362/161, 159, 362/393, 181, 172, 186, 122, 124, 154, 156, 253, 351, 361, 392; 428/7; 248/159; 431/296

(56) References Cited

U.S. PATENT DOCUMENTS

| | | | | | |
|---|---|---|---|---|---|
| 216,628 | A | * | 6/1879 | Moses | 428/7 |
| 244,045 | A | * | 7/1881 | Geddes | 428/7 |
| 319,319 | A | * | 6/1885 | Reichard | 428/7 |
| 363,679 | A | * | 5/1887 | Reed | 428/7 |
| 715,379 | A | * | 10/1902 | Herd | 428/7 |
| 1,309,893 | A | * | 7/1919 | Johnson | 428/7 |
| D262,999 | S | | 2/1982 | Spencer | |
| D271,056 | S | * | 10/1983 | Perkins | D26/11 |
| 4,955,807 | A | * | 9/1990 | Chance et al. | 431/296 |
| D357,085 | S | | 4/1995 | Ratia | |
| 5,601,272 | A | * | 2/1997 | Adams et al. | 248/518 |
| 5,613,760 | A | | 3/1997 | Dunn | |
| D396,119 | S | | 7/1998 | Allison | |
| 5,879,151 | A | | 3/1999 | Schultz et al. | |
| D422,720 | S | | 4/2000 | Hardy | |
| 6,106,279 | A | | 8/2000 | Hedlund | |
| 6,234,786 | B1 | | 5/2001 | Wagner | |
| 6,540,371 | B2 | * | 4/2003 | Franks | 362/122 |
| 2003/0067770 | A1 | * | 4/2003 | Bonnema et al. | 362/186 |

* cited by examiner

*Primary Examiner*—Stephen Husar
*Assistant Examiner*—Anabel Ton
(74) *Attorney, Agent, or Firm*—DeLio & Peterson, LLC; Robert Curcio, Esq.

(57) ABSTRACT

The present invention provides for a jack-o-lantern lid mounted candle holder in the form of a shaped rod. The shaped portions of the rod are formed in integrally connecting segments. A candle mount portion, a candle base support portion, a vertical hanging portion, and a lid attachment portion form the candle holder. The rod material forming the candle mount portion is shaped to be substantially circular having one end of the rod overlapping and completing the circle where the candle base support portion begins. The overlapping end of the circular portion allows the user to adjust the compressible, extendable rod firmly to hold candles of different diameters. A candle may be placed within the candle mount portion by extending the candle mount portion outwards to enlarge the diameter of the candle mount portion's circular segment. The candle base support portion has a vertical leg segment that begins at the candle mount portion and extends vertically to a straight edge segment. The straight edge segment is positioned horizontally with respect to the vertical hanging portion and parallel to and underneath the candle mount portion. The straight edge segment provides support for the bottom end of a candle held by the candle mount portion. The straight edge segment is below the candle mount portion, and substantially centered with respect to the candle mount portion circle.

4 Claims, 5 Drawing Sheets

CANDLE HOLDER FOR JACK-O-LANTERN LID AND METHOD OF APPLYING THE SAME

BACKGROUND OF THE INVENTION

1. Field of the Invention

The present invention relates generally to a device for placing and securing a candle within a hollowed-out pumpkin or jack-o-lantern. More particularly, the present invention relates to a candle holder for attaching a candle to the lid of a jack-o-lantern, and the method of applying the same.

2. Description of Related Art

A hollowed-out pumpkin with carved holes or jack lantern is commonly displayed with a lighted candle inside, such that the candle light passes through the carved out holes in the pumpkin sidewalls. Historically, a lid is carved out at the top of the pumpkin, and pumpkin seeds and pulp are removed. Holes are then carved through the walls of the pumpkin. The candles are placed inside the hollowed-out pumpkin on its inside bottom surface. However, the inside bottom of a hollowed-out pumpkin or jack lantern has a mound, known as the bloom point, that makes it difficult to securely fix a candle at that spot. Prior art designs have attempted to overcome this candle mounting instability by cradling a candle within melted wax formed at the bottom of the pumpkin; securing a candle by melted wax to a small dish or plate and placing the plate on the pumpkin bloom point; or placing a candle within a mounting frame with a base that either secures directly to the bloom, or sets over the bloom, expanding beyond the circumference of the bloom.

In U.S. Pat. No. 4,955,807 issued on Sept. 11, 1990 to Chance, et al., entitled, "SPIRAL COIL CANDLE HOLDER FOR PUMPKINS AND OTHER SUBSTRATES," a spiral coil candle holder is used to anchor a candle to the bottom of a jack-o-lantern at the bloom point. The candle holder has a spiral bottom so that it can be embedded into the hollowed-out pumpkin bottom in a cork-screw-like fashion.

In U.S. Pat. No. 6,106,279 issued on Aug. 22, 2000 to Hedlund, entitled, "CANDLE HOLDER FOR JACK-O-LANTERN," a candle holder having a generally hemispherical shaped base with a centrally disposed candle mounting portion is positioned directly over the bloom point of a hollowed-out pumpkin. The candle holder is provided with a hollow interior in order to accommodate the bloom point on the bottom of the pumpkin.

In U.S. Pat. No. Des. 396,119 issued to Allison on Jul. 14, 1998, entitled, "SAFE JACK-O-LANTERN CANDLE STAND," a flat plat having a circular hole in which a candle may be placed, and four bendable legs are depicted. The stand is made to raise the candle above the bloom, with each leg resting on the pumpkin inside bottom surface.

Each of these prior art designs teach and suggest placement of a jack-o-lantern candle holder on the inside surface of the pumpkin bottom in a manner that accommodates the pumpkin bloom point. In each case however, lighting the candle after placement within its holder, which is secured to the pumpkin inside bottom surface, requires the user to perform one of the following techniques: a) remove the candle from the holder and then replace it after lighting, risking burn to the user; b) turn the pumpkin on its side to light the candle, thereby avoiding the possibility of flame rising in the direction of the user; or c) insert a lighted match directly down and within the hollowed-out pumpkin, again risking burn to the user.

Although not taught or suggested for jack-o-lanterns, some candle holder designs attach to the top lip of a sidewall of a transparent container or vase. For example, in U.S. Pat. No. Des. 357,085 issued to Ratia on Apr. 4, 1995, entitled, "COMBINED CANDLE HOLDER AND SPOON THEREFOR," a spoon-ladle shaped candle holder, having a flat, circular bottom surface with holes therethrough and a wall circumferentially attached, is held to the sidewall of a container by a handle, curved at the top so that the curved portion hooks around and rests upon the top lip of the container. This design, however, does not teach or suggest a way to secure the candle to the candle holder, or the candle holder to the container sidewall. The candle holder, and the candle itself, may move with even slight motion of the container. Moreover, a lid placed over the top of the container orifice would not seat properly in this design due to the protruding candle holder curved handle portion resting on the top lip. Similar candle holder designs having these limitations are demonstrated by U.S. Pat. No. Des. 422,720 issued to Hardy on Apr. 11, 2000, entitled, "CANDLE LANTERN AND SPOON THEREFOR," and by U.S. Pat. No. Des. 271,056 issued to Perkins on Oct. 18, 1983, entitled, "CANDLE HOLDE R."

Bearing in mind the problems and deficiencies of the prior art, it is therefore an object of the present invention to provide a candle holder for a jack-o-lantern that secures a candle upright therein.

It is another object of the present invention to provide a candle holder for a jack-o-lantern that is independent of the mounting instability created by the pumpkin bottom and pumpkin bloom point.

A further object of the present invention to provide a candle holder for a jack-o-lantern that facilitates the lighting of the candle without undue risk of burning the user.

Another object of the present invention is to provide a candle holder for a jack-o-lantern that may be secured to the pumpkin while allowing for complete circumferential lid seating.

A further object of the present invention is to provide a candle holder for a jack-o-lantern that facilitates the lighting of the candle without removing the candle from the candle holder.

It is yet another object of the present invention to provide a method of applying a candle holder to a jack-o-lantern that secures the candle holder while allowing easy access to the candle for lighting.

Still other advantages of the invention will in part be obvious and will in part be apparent from the specification.

SUMMARY OF THE INVENTION

The above and other objects, which will be apparent to those skilled in the art, are achieved in the present invention which is directed to an apparatus for securing a candle to a jack-o-lantern lid, comprising: an integrally formed single rod having a first and second end, the rod including: a candle mount portion; a candle base support portion beginning from, and connecting to, the candle mount portion; a vertical hanging portion beginning from, and connecting to, the candle base support portion; and a lid attachment portion beginning from, and connecting to, the vertical hanging portion.

The candle mount portion is adjustable, and includes a substantially circular segment, horizontally positioned relative to the vertical hanging portion. The candle base support portion comprises a straight edge segment of the rod, horizontally positioned relative to the vertical hanging portion, and substantially parallel to and below the candle mount portion; the straight edge segment providing support for a candle base. The vertical hanging portion has a predetermined length, and positioned substantially perpendicular to the candle base support portion. The lid attachment portion includes: a hooked segment, curved with respect to the vertical hanging portion for insertion through the jack-o-lantern lid; and an extension segment extending from the hooked segment and terminating at the rod second end.

In a second aspect, the present invention is directed to an apparatus for securing a candle to a jack lantern lid, having a rod with a first and second end, comprising: an extendable and compressible candle mount portion; a candle base support portion; a vertical hanging portion; and a lid attachment portion.

The rod comprises bendable material. The rod comprises integrally shaped portions. The rod may also be molded from heat resistant polymer, constructed from metal, or constructed of a material which will not be deformed from the heat generated from the flames of the candle placed in the candle mount portion.

In a third aspect, the present invention is directed to an apparatus for attaching a candle to a jack-o-lantern lid comprising a rod having first and second ends, with integrally shaped portions including: an adjustable candle mount portion having a substantially circular segment, horizontally positioned relative to a vertical hanging portion; a candle base support portion having a straight segment of the rod horizontally positioned relative to the vertical hanging portion, and substantially parallel to and below the candle mount portion; the vertical hanging portion having a predetermined length, and positioned substantially perpendicular to the candle base support portion; and a lid attachment portion including: a hooked segment, curved substantially 180° with respect to the vertical hanging portion for insertion through the jack-o-lantern lid; and an extension segment extending from the hooked segment and terminating at the rod second end. The present invention may also accommodate wax candles of different diameters.

In a fourth aspect, the present invention is directed to a method of attaching a rod-formed candle holder, having first and second ends, to a jack-o-lantern lid having a top and bottom surface, the method comprising: removing the lid from the jack-o-lantern; puncturing the bottom surface of the jack-o-lantern lid with the candle holder second end and extending a portion of the candle holder through the lid top surface; bending the portion of the candle holder extending beyond the lid top surface such that the candle holder second end comes in contact with the lid top surface; puncturing the top surface of the lid with the candle holder second end; placing the candle holder inside the jack-o-lantern by placing the lid on the jack-o-lantern. Bending the portion of the candle holder extending beyond the lid top surface further comprises adjusting the candle holder portion extending below the lid bottom surface for height such that the candle holder fits inside the jack-o-lantern when the lid is attached. A portion of the candle holder is then extended through the lid after puncturing the top surface of the lid with the candle holder second end.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS)

In describing the preferred embodiment of the present invention, reference will be made herein to FIGS. 1–5 of the drawings in which like numerals refer to like features of the invention.

As indicated above, a candle holder that is secured to the lid of a jack-o-lantern is absent in the prior art teachings. The present invention provides for a jack-o-lantern lid mounted candle holder in the form of a shaped rod. Preferably, the shaped portions of the rod are formed in integrally connecting segments. The rod may be made from any bendable material, provided the material can withstand the heat generated from the flames of the candle without deformation. Preferably, the rod is constructed of metal or molded from a heat resistant polymer. The rod material must be structurally capable of puncturing a pumpkin and supporting the weight of a candle. Additionally, the rod material must be compressible and extendable in order to secure and hold candles having different diameters.

Figure 1:
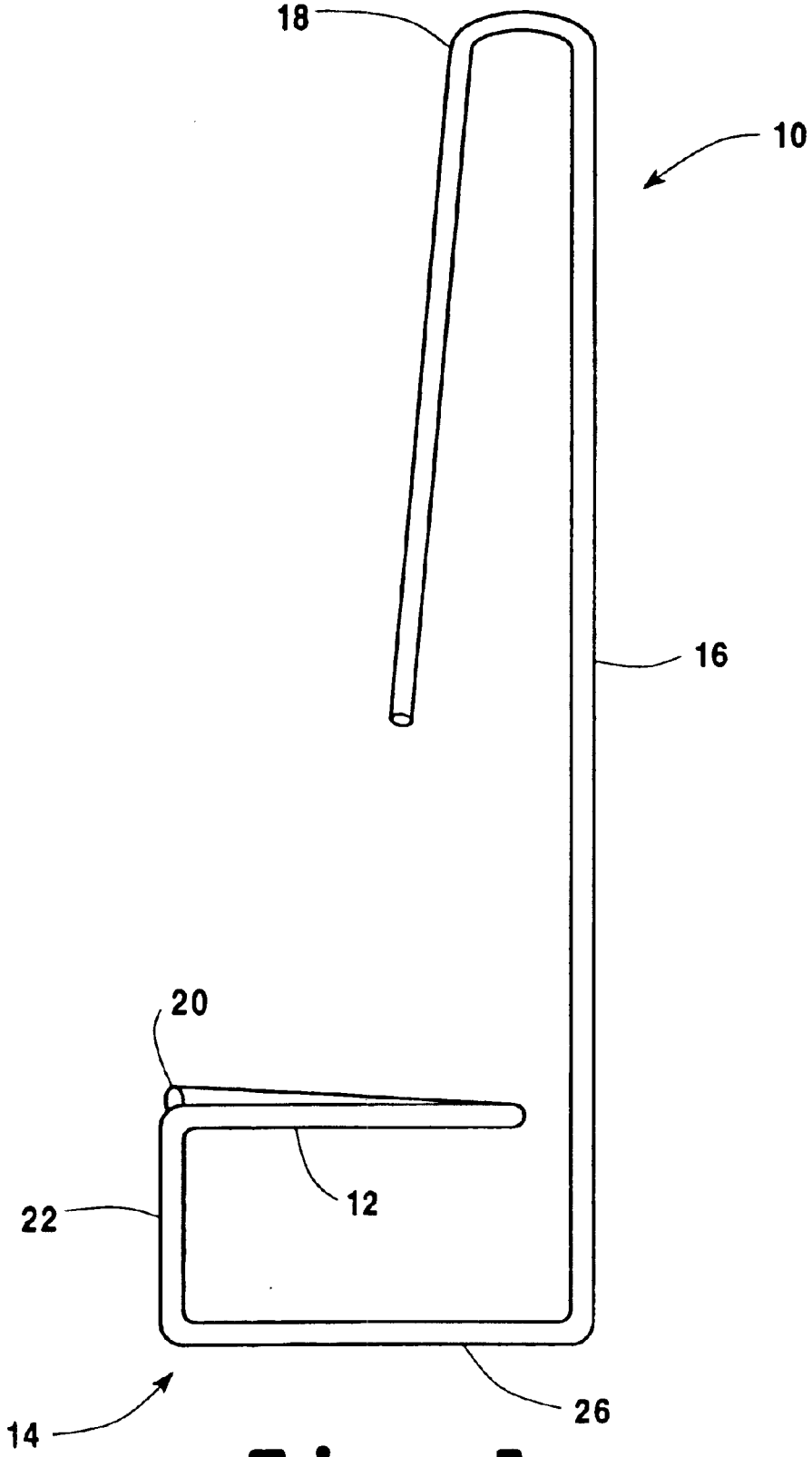
FIG. 1 is a side view of the jack-o-lantern candle holder formed by a rod shaped into integrally connecting portions.
Figure 2:
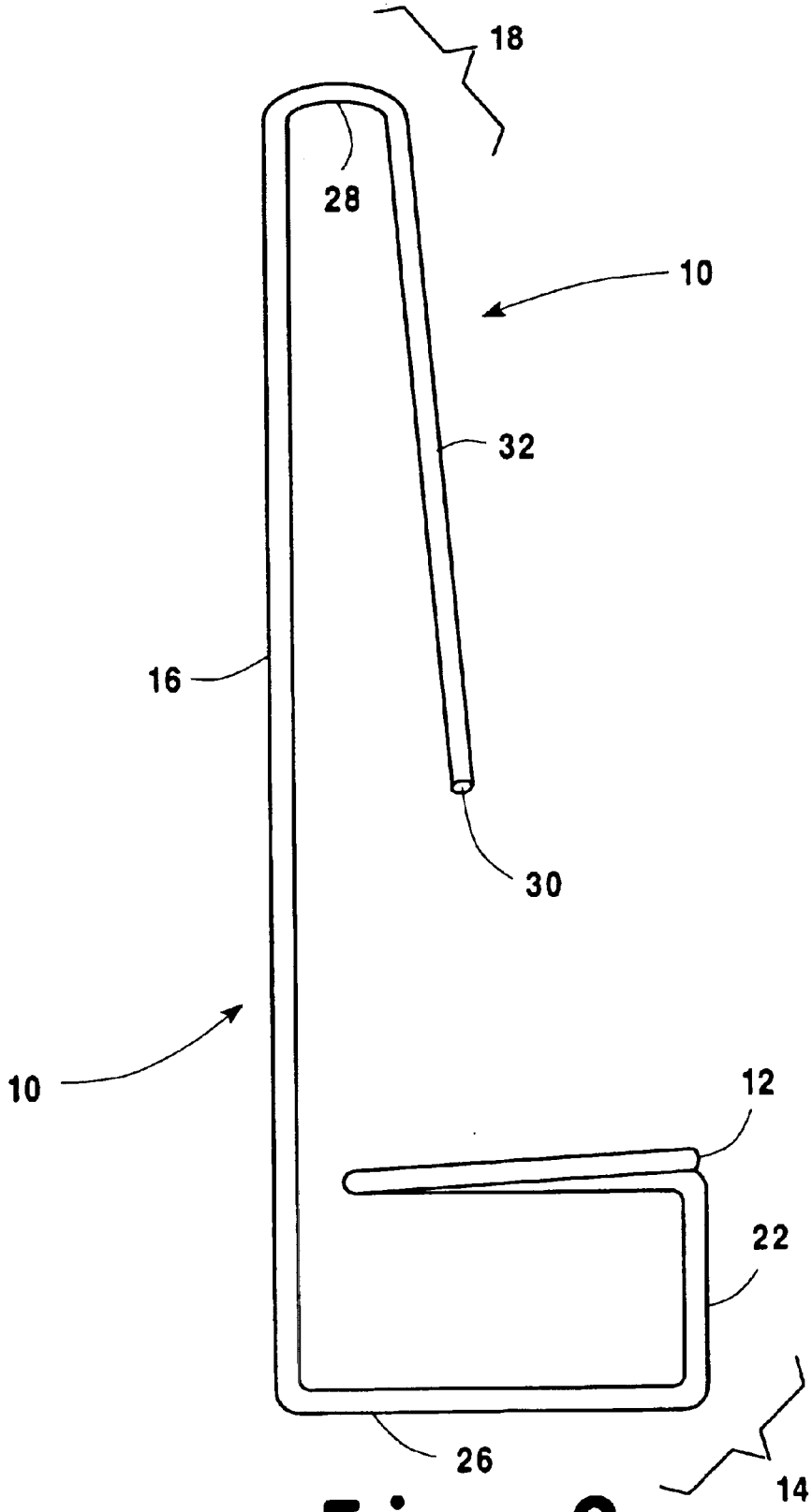
FIG. 2 is an opposing side view of the jack-o-lantern candle holder of FIG. 1, formed by a rod shaped into integrally connecting portions.
Figure 3:
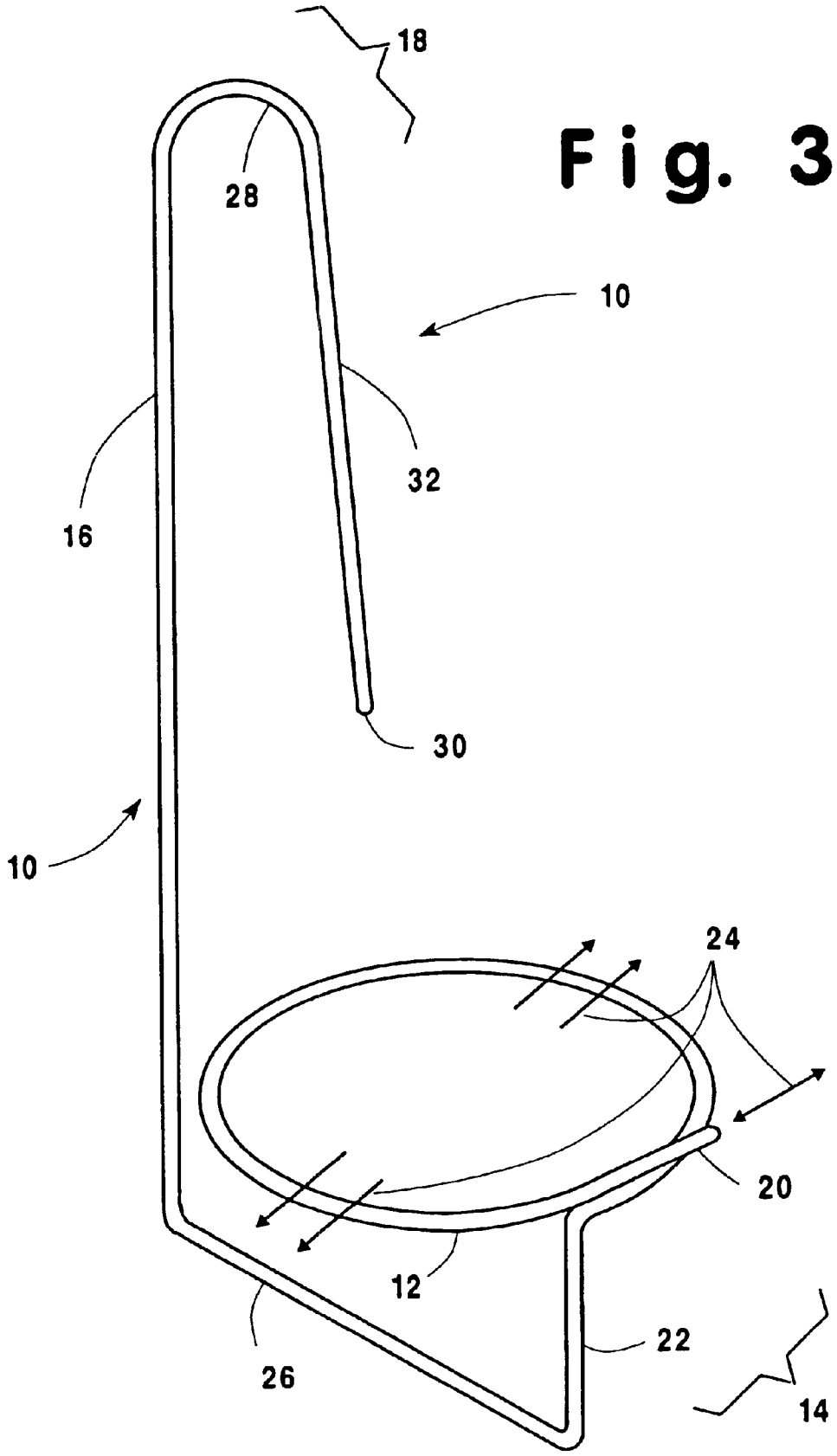
FIG. 3 is an off-axis top-down view of the candle holder.

FIGS. 1 and 2 depict opposing side views of the jack-o-lantern candle holder formed by a rod shaped into integrally connecting portions. A candle mount portion 12, a candle base support portion 14, a vertical hanging portion 16, and a lid attachment portion 18 form the candle holder 10. The rod material forming the candle mount portion 12 is shaped to be substantially circular having one end of the rod 20 overlapping and completing the circle where the candle base support portion begins 22. The overlapping end of the circular portion allows the user to adjust the compressible, extendable rod firmly to hold candles of different diameters. FIG. 3 represents an off-axis top-down view of the candle holder. Arrows 24 depict the movement of the compressible, extendable candle mount portion 12.

As shown in FIGS. 1 and 2, the candle mount portion is horizontally positioned relative to the vertical hanging portion 16. The candle mount portion 12 is integrally formed with the candle base support portion 14. The candle base support portion has a vertical leg segment 22 that begins at the candle mount portion 12 and extends vertically to a straight edge segment 26. The straight edge segment 26 is positioned horizontally with respect to the vertical hanging portion 16 and parallel to and underneath the candle mount portion 12. The straight edge segment 26 provides support for the bottom end of a candle held by the candle mount portion. The straight edge segment is below the candle mount portion 12, and substantially centered with respect to the candle mount portion circle.

The candle base support portion is then integrally formed into the vertical hanging portion 16. The vertical hanging portion 16 determines the depth of the candle holder within the jack-o-lantern as measured from the inside surface of the lid to the bottom of the straight edge segment 26. This depth distance is predetermined when the candle holder is attached to the jack-o-lantern lid. The lid attachment portion 18 of the candle holder begins from, and connects to, the vertical hanging portion 16. The lid attachment portion is curved in a hooked segment 28 at approximately 180°, directing an extension segment 32 and rod end 30 towards the candle mount portion 12. The extension segment 32 is substantially parallel to the vertical hanging segment 16.

Figure 4:
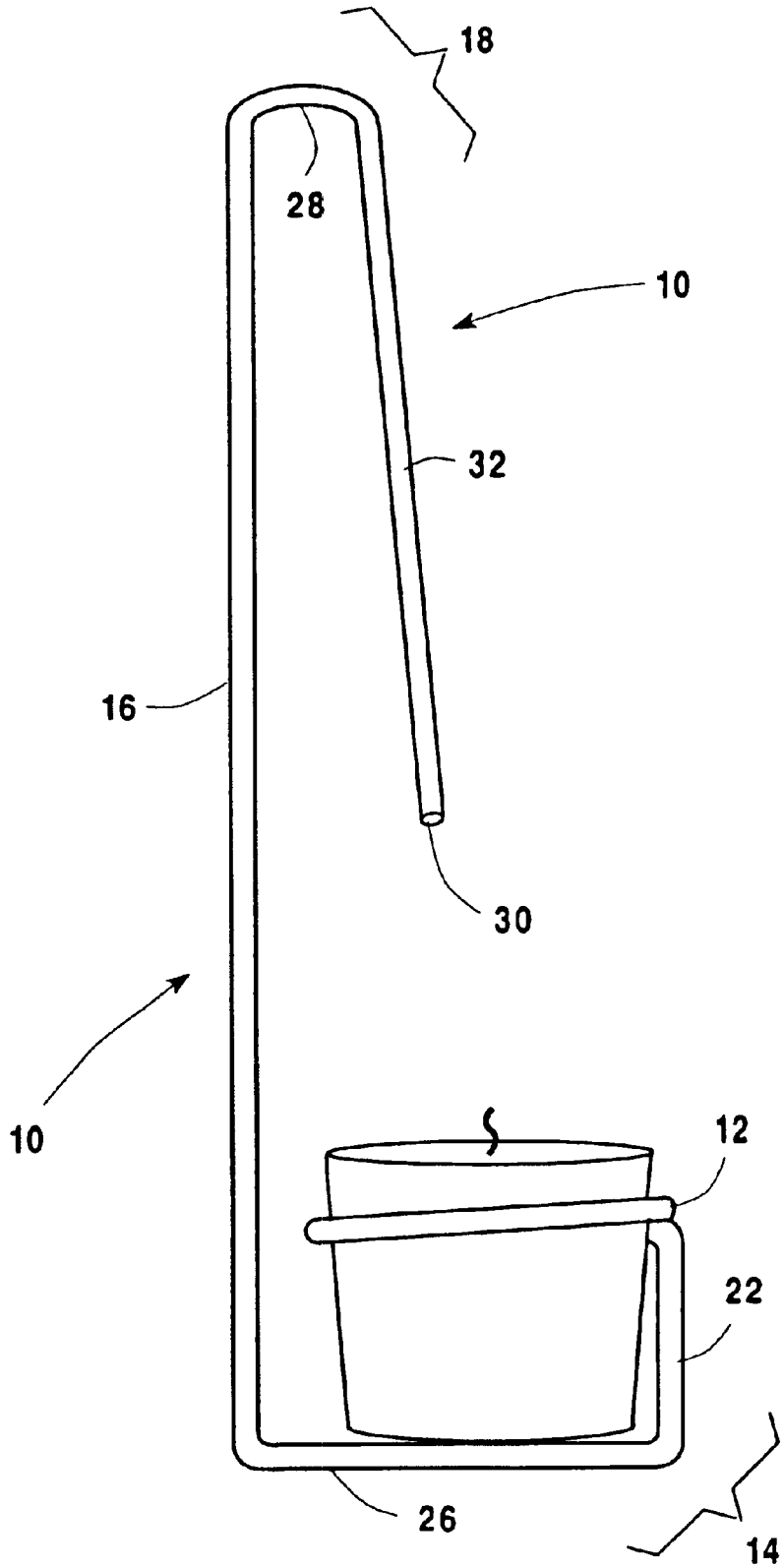
FIG. 4 is a side view of the jack-o-lantern candle holder shown with a candle in position.

A candle may be placed within the candle mount portion by extending the candle mount portion 12 outwards to enlarge the diameter of the candle mount portion's circular segment. Arrows 24 of FIG. 3 depict the direction of the extension and compression of the candle mount portion. Once a candle is in place, with its bottom resting on the candle base support portion's straight edge segment 26, the extended candle mount circular segment is released, and tightly holds the candle in place. Preferably, a votive candle is used for this application; however, many different types of candles may be used, with the limitation that the outer diameter of the candle be less than the maximum extendable diameter of the candle mount portion. FIG. 4 is a side view of the jack-o-lantern candle holder shown with a candle in position.

Figure 5:
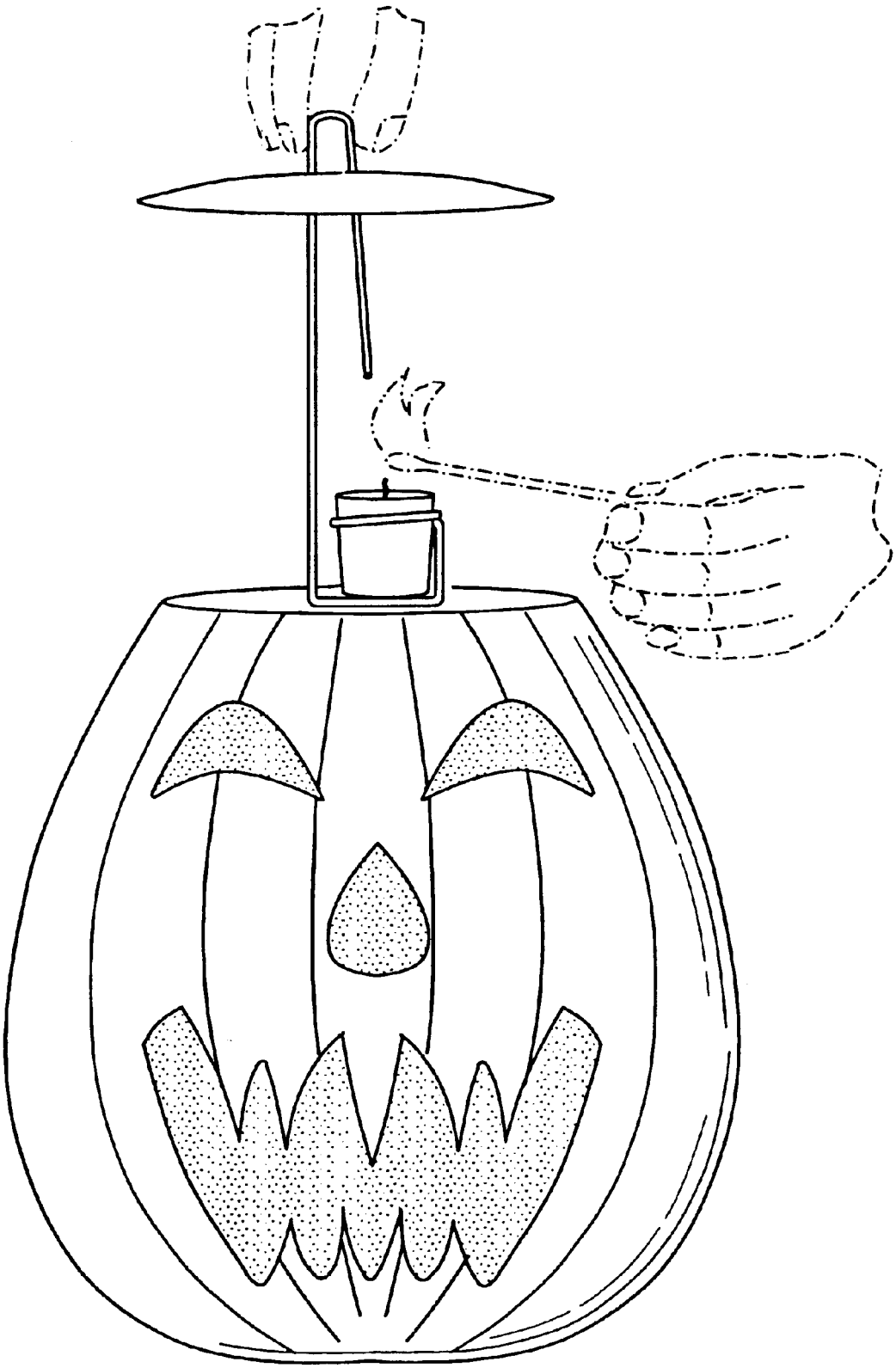
FIG. 5 depicts the candle holder of the present invention attached to a jack-o-lantern lid, and placed inside a jack-o-lantern.

The candle holder is installed within a jack-o-lantern lid by first puncturing the inside bottom surface of the lid with rod end 30, and extending the lid attachment portion 18 therethrough. The candle holder is extended through the lid until a desired distance from the inside bottom surface of the lid to the candle base support straight edge segment 26 is determined. This predetermined distance is predicated on the depth of the pumpkin used to make the jack-o-lantern, and should place the straight edge segment above the bloom point of the pumpkin when the lid is placed on the pumpkin. The extended lid attachment portion on the outer side of the lid is then bent so that rod end 30 is able to penetrate the lid top surface. The lid attachment extension segment then traverses through the lid. FIG. 5 depicts the candle holder of the present invention attached to a jack-o-lantern lid, and placed inside a jack lantern.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of attaching a rod-formed candle holder, having first and second ends, to a jack-o-lantern lid having a top and bottom surface, said method comprising:

removing said lid from said jack-o-lantern;

puncturing said bottom surface of said jack-o-lantern lid with said candle holder second end and extending a portion of said candle holder through said lid top surface;

bending said portion of said candle holder extending beyond said lid top surface such that said candle holder second end comes in contact with said lid top surface;

puncturing said top surface of said lid with said candle holder second end;

placing said candle holder inside said-o-jack lantern by placed said lid on said jack-o-lantern.

2. The method of claim 1 wherein bending said portion of said candle holder extending beyond said lid top surface further comprises first adjusting said candle holder portion extending below said lid bottom surface for height such that said candle holder fits inside said jack-o-lantern when said lid is attached.

3. The method of claim 1 further comprising extending a portion of said candle holder through said lid after puncturing said top surface of said lid with said candle holder second end.

4. The method of claim 3 further comprising removing excess candle holder material from said portion of said candle holder extending through said lid after puncturing said top surface of said lid.

* * * * *

UNITED STATES PATENT AND TRADEMARK OFFICE

CERTIFICATE OF CORRECTION

PATENT NO. : 6,869,200 B1
DATED : March 2, 2005
INVENTOR(S) : Graham

It is certified that error appears in the above-identified patent and that said Letters Patent is hereby corrected as shown below:

Column 6,
Line 25, delete "-o-jack lantern by placed" and substitute therefor -- jack-o-lantern by placing --.

Signed and Sealed this

Twenty-eighth Day of June, 2005

JON W. DUDAS
*Director of the United States Patent and Trademark Office*